US009938667B2

(12) United States Patent
Olmos et al.

(10) Patent No.: US 9,938,667 B2
(45) Date of Patent: Apr. 10, 2018

(54) METHOD OF PROVIDING A SECURITY DOCUMENT WITH A SECURITY FEATURE, AND SECURITY DOCUMENT

(71) Applicant: FÁBRICA NACIONAL DE MONEDA Y TIMBRE-REAL CASA DE LA MONEDA, Madrid (ES)

(72) Inventors: Antonio Olmos, Madrid (ES); Maurizio Lazzerini, Milan (IT); Vicente Garcia Juez, Madrid (ES)

(73) Assignee: FÁBRICA NACIONAL DE MONEDA Y TIMBRE-REAL CASA DE LA MONEDA, Madrid (ES)

( * ) Notice: Subject to any disclaimer, the term of this patent is extended or adjusted under 35 U.S.C. 154(b) by 35 days.

(21) Appl. No.: 14/888,663

(22) PCT Filed: May 7, 2014

(86) PCT No.: PCT/EP2014/059309
§ 371 (c)(1),
(2) Date: Nov. 2, 2015

(87) PCT Pub. No.: WO2014/180885
PCT Pub. Date: Nov. 13, 2014

(65) Prior Publication Data

US 2016/0108581 A1 Apr. 21, 2016

(30) Foreign Application Priority Data

May 10, 2013 (EP) ..... 13382175

(51) Int. Cl.
*B42D 25/435* (2014.01)
*B42D 25/355* (2014.01)
(Continued)

(52) U.S. Cl.
CPC ..... *D21H 21/48* (2013.01); *B41M 3/14* (2013.01); *B41M 5/24* (2013.01); *B42D 25/346* (2014.10);
(Continued)

(58) Field of Classification Search
CPC ..... B42D 25/355; B42D 25/435
See application file for complete search history.

(56) References Cited

U.S. PATENT DOCUMENTS 28,370 A 5/1860 Howell, Jr.
4,462,867 A 7/1984 Fuller
(Continued)

FOREIGN PATENT DOCUMENTS

CN 1556752 A 12/2004
CN 1575483 A 2/2005
(Continued)

OTHER PUBLICATIONS

CN Office Action dated Nov. 3, 2016 re; Application No. 201480024913,5; pp. 1-24; citing: CN1575483A, CN1556752A, US4462867A, WO2007/071939A2 and CN101754362A.
(Continued)

*Primary Examiner* — Kyle Grabowski
(74) *Attorney, Agent, or Firm* — Cantor Colburn LLP

(57) ABSTRACT

A security document (1) comprises a paper document substrate (11) and a security element (2) embedded in said document substrate (11). The security element comprises an element substrate (21) and a material (22) sensitive to laser light. The method comprises the step of directing laser light (41) onto the document substrate (11) so as to alter said material (22), so as to provide said security element (2) with a detectable marking (3).

18 Claims, 8 Drawing Sheets

(51) Int. Cl.

| | |
|---|---|
| ***D21H 21/48*** | (2006.01) |
| ***B41M 3/14*** | (2006.01) |
| ***B41M 5/24*** | (2006.01) |
| ***D21H 21/40*** | (2006.01) |
| ***D21H 21/42*** | (2006.01) |
| ***B42D 25/369*** | (2014.01) |
| ***B42D 25/346*** | (2014.01) |
| ***B42D 25/373*** | (2014.01) |
| ***B42D 25/36*** | (2014.01) |
| ***B42D 25/41*** | (2014.01) |

(52) U.S. Cl.

CPC ..... *B42D 25/355* (2014.10); *B42D 25/36* (2014.10); *B42D 25/369* (2014.10); *B42D 25/373* (2014.10); *B42D 25/41* (2014.10); *B42D 25/435* (2014.10); *D21H 21/40* (2013.01); *D21H 21/42* (2013.01)

(56) References Cited

U.S. PATENT DOCUMENTS

| | | | | |
|---|---|---|---|---|
| 7,390,556 | B2 * | 6/2008 | Lazzerini | B42D 25/355 283/72 |
| 2003/0161017 | A1 * | 8/2003 | Hudson | B42D 25/328 359/2 |
| 2004/0232691 | A1 | 11/2004 | Lazzerini | |
| 2005/0142342 | A1 | 6/2005 | Lutz et al. | |
| 2006/0145468 | A1 | 7/2006 | Plaschka et al. | |
| 2008/0036195 | A1 * | 2/2008 | Winchcombe | B42D 25/00 283/85 |
| 2008/0187851 | A1 | 8/2008 | Kurittu | |
| 2008/0191462 | A1 | 8/2008 | Depta et al. | |
| 2008/0250954 | A1 * | 10/2008 | Depta | B42D 25/41 283/87 |
| 2009/0302595 | A1 * | 12/2009 | Rubio Sanz | B42D 25/355 283/82 |
| 2010/0164217 | A1 | 7/2010 | Gregarek et al. | |
| 2010/0272313 | A1 | 10/2010 | Yamauchi et al. | |
| 2012/0103545 | A1 | 5/2012 | Rancien | |

FOREIGN PATENT DOCUMENTS

| | | | | |
|---|---|---|---|---|
| CN | 101754862 | A | 6/2010 | |
| EP | 1291827 | B1 | 3/2003 | |
| EP | 1652687 | A1 | 5/2006 | |
| EP | 1669213 | A1 | 6/2006 | |
| EP | 1872965 | A1 | 1/2008 | |
| EP | 2284015 | A1 | 2/2011 | |
| EP | 2692539 | A1 | 2/2014 | |
| GB | 1095286 | A | 12/1967 | |
| JP | 2005279940 | A | 10/2005 | |
| JP | 2008529823 | A | 8/2008 | |
| JP | 2011016291 | A | 1/2011 | |
| WO | 02101147 | A1 | 12/2002 | |
| WO | 2004050991 | A1 | 6/2004 | |
| WO | 2007071939 | A2 | 6/2007 | |
| WO | WO 2007071939 | A2 * | 6/2007 | B42D 25/355 |
| WO | 2009106066 | A1 | 9/2009 | |
| WO | 2009127325 | A1 | 10/2009 | |
| WO | WO 2009127325 | A1 * | 10/2009 | B41M 5/26 |
| WO | 2013037473 | A1 | 3/2013 | |

OTHER PUBLICATIONS

JP Office Action dated Aug. 8, 2016 re: Application No. 2016-512356; pp. 1-6; citing: JP 2011-16291 and JP 2008-529823.

International Preliminary Report on Patentability dated Sep. 8, 2015 re: Application No. PCT/EP2014/059309; pp. 1-11; citing: US 2004/232691 A1, US 2012/103545 A1 and US 2008/191462 A1.

International Search Report dated Jul. 9, 2014 re; Application No. PCT/EP2014/059309; pp. 1-4; citing: US 2004/232691 A1, US 2012/103545 A1, US 2008/191462 A1, US 2006/145468 A1 and EP 2 692 539 A1.

* cited by examiner

METHOD OF PROVIDING A SECURITY DOCUMENT WITH A SECURITY FEATURE, AND SECURITY DOCUMENT

TECHNICAL FIELD

The present invention is related to the field of security documents.

BACKGROUND

Security documents, including value documents such as banknotes and cheques, and identity documents such as passports and identity cards, are frequently subjected to fraud. In order to increase security and to make forgery more difficult, security documents are frequently provided with so-called security elements, applied onto or inserted into said security documents. The security elements can, for example, provide controlled responses to external stimuli, and/or provide certain visual effects, thereby allowing for the verification of the authenticity of the document into which they have been incorporated.

The configuration, design and composition of a security element is often intended to remain unaltered once it has been incorporated into the security document, for example, applied to or inserted into a substrate of the security document, such as a paper substrate of the security document. Generally, the security element is intended to maintain its properties until the end of the life cycle of the security document, although sometimes alterations may occur due to, for example, wear and tear caused by the use of the document.

Security elements can be in the form of, for example, security threads or strips, luminescent fibres, iridescent strips or planchettes, holographic tags, patches or strips, solid microparticles, reactive chemical agents or printed security inks. It is known to place this kind of elements inside the paper substrate of a document or within the pulp from which the substrate is produced (this is often the case with security threads, strips, fibres, microparticles or reactive chemical agents) or on the surface of the substrate (this is often the case with patches, holographic strips, reactive chemical agents or printed strips). It is known to place security elements at specific positions of a substrate and/or in register with other security features of a substrate (this is frequently the case with security threads and strips, holographic strips, and printed inks), but security elements can also be distributed randomly on or in the substrate (this is often the case with fibres, solid microparticles, and reactive chemical agents).

The incorporation of the security elements into the security document contributes to making forgery more difficult in at least two different ways, namely: due to the difficulty of manufacturing the security elements; due to the difficulty of incorporating the element into the substrate (especially if placed in register with other features). The level of difficulty can be further enhanced if several security elements are incorporated in the same security document, and especially of they are placed very close to each other.

The position in register or the precise positioning of each security element in a substrate makes it possible to incorporate a relatively large amount of security elements in the substrate. On the contrary, when there are substantial tolerances in the positioning of a security element in a substrate, it may be necessary to increase the space between security elements so as to reduce the risk of non-desired interaction or overlapping between security elements; this implies a restriction on the amount of security elements that can be incorporated into and/or onto the substrate of the security document.

A large number of prior art references teach different aspects related to the incorporation of security threads or ribbons into paper substrates.

For example, GB-1095286-A discloses the use of thin security ribbons which are incorporated into a security paper. Said ribbons contain, before their incorporation into the paper, different graphical designs in the form of characters or symbols which can also be visually detected, through the use of lenses or microscopes, once incorporated into the paper.

WO-2004/050991-A1 discloses a method for manufacturing a security paper in which a security thread is partially embedded in such a way that there are areas of the said security thread which remain exposed. The holographic or metallized graphical motifs can thus be seen with the naked eye, in the same way in which they could be seen on the thread before it was inserted into the paper substrate. In addition, it is described that this thread will be positioned at a specific distance from (that is, in register with) a watermark, in order to facilitate the control of the position.

One problem frequently involved with the use of security threads is that the substrate is deformed by the security thread, as the presence of the security thread in the substrate increases the thickness of the substrate locally, as the thickness of the security thread is added to the thickness of the paper as such. This is the reason for why, in bank notes, the position of the security thread often varies between different individual bank notes of the same kind: frequently, the position of the security thread in the bank note, in the cross direction (that is, the direction perpendicular to the machine direction, which corresponds to the axial direction of the security thread), can vary several mm if different banknotes are compared. This prevents the increased thickness of the individual banknotes at the location of the security thread to accumulate and produce an excessive bulging of a stack of banknotes comprising a large number of superposed banknotes of the same kind.

However, this implies a difficulty when a certain security feature of a security thread, such as an image, symbol, marking, or other characteristic of the security thread, or the security thread itself, is to be placed in register with a security feature which forms part of the substrate of the document, such as an image, symbol or other mark printed on a paper substrate. For example, if an image printed on a security thread is to be placed in register with an image printed on a substrate into which the thread is to be inserted, this may be difficult or impossible if the position of the security thread is not the same in all substrates, such as, for example, in the paper substrates of a plurality of bank notes.

Also, when substrates for security documents are produced by cutting from a sheet or bobbin of the substrate material already containing the security thread (such as a sheet or web of paper or other cellulose based material), tolerances in the cutting process may affect the position of the security thread within the individual substrate, for example, in relation to the edge of the substrate. That is, if comparing a plurality of cut substrates, the security thread may not always be in the same position in relation to an edge or side of the substrate, for example, in the case of bank notes, typically in relation to one of the shorter sides, which often are parallel with the security thread.

Sometimes, an intended variation in the position of the security thread (for example, as in the case of banknotes, for the purpose of preventing all of the security threads from being exactly superimposed on top of each other when stacking banknotes, so as to prevent the stack from bulging excessively) can add up with a variation due to tolerances in the processes of insertion of the security threads into the substrates and/or cutting of the substrates, thereby giving rise to a substantial variability of the position of the security thread in relation to a reference point of a substrate, such as an edge of the substrate.

That is, to prevent the locally increased thickness of the substrate to accumulate excessively when many substrates are placed on top of each other, and in order to avoid the risk for "non-valid" substrates due to the tolerances in the insertion of the threads and/or cutting of the substrates from a large sheet or band, it is known to vary the position of the security thread in a controlled way within a predetermined interval, so that if comparing a number of substrates, the thread will not always be in the same position within the document (for example, in relation to an edge or side of the substrate or security document): the thread will be placed in a position that can vary within a given range, for example, with +/− a few millimeters from a reference position. However, this varying position of the thread may raise doubts with regard to the validity or authenticity of the document, for example, when a layman examines two banknotes and observes that the security threads are not placed in the same position.

Also, as indicated above, a further problem involved with a lack of register between a security element and a substrate is that it restricts the possibility of adding further security elements, due to the risk of interference between different security elements when they are very near each other of when they overlap each other.

EP-1872965-A1 teaches a security thread, strip or band comprising a cellulose support which can act as a carrier for security elements such as pigments, synthetic elements and/or security fibers, and which can be inserted into a paper substrate, whereby the cellulose substrate of the security strip can be completely integrated in the paper pulp, although without disappearing as an independent element. The fact that both the substrate of the security strip as the paper substrate into which it is integrated, that is, the substrate of the security document, to a substantial extent are made up of cellulose fibres, facilitates the integration between the substrate of the security document (hereinafter also referred to as the "document substrate") and the substrate of the security element (hereinafter also referred to as the "element substrate"). Due to this integration, such a cellulose strip does not contribute to an increase in the thickness of the document substrate in the same way as, for example, a metal or plastic strip. The strip can be provided with detectable symbols or other security features.

A known way of arranging a security feature of a security element in register with a substrate includes forcing, in a controlled manner, the variation of the visual appearance of the security element after it has been applied to the substrate.

For instance, US-2008/0191462-A1 discloses a security document with a paper substrate, having a coating on a portion of its surface. The coating includes a metallic layer which is modified by laser light, thereby marking the coating. This marking can be made in register with markings on the paper outside the coating, as shown in US-2008/0191462-A1. However, a problem with the method is that the marking is carried out on the surface of the document, wherefore the marked portions can easily be subjected to wear and degradation during use of the document, which can lead to doubts about its authenticity. Also, superficial markings can sometimes be subjected to fraudulent alterations.

The use of laser light for producing security features in security documents or elements is well known in the art.

For example, US-2010/0164217 teaches a method for manufacturing a security feature for a security element, a security paper or a data carrier that exhibits a substrate into which at least one through opening and at least one marking in register with the through opening are to be introduced.

US-2010/0272313-A1 teaches a forgery prevention medium that includes a volume hologram layer on which an interference pattern is recorded after being exposed to at least an emitted laser beam; a digital watermarking information layer on which digital watermarking information is recorded; and a substrate film.

WO-2009/106066-A1 discloses a security document including a layer with components sensitive to a laser light source, allowing for laser marking of the document.

JP-2005-279940-A discloses a printable security sheet, comprising a multilayer paper structure with an inner resin layer which can be altered by laser light.

US-2005/0142342-A1 discloses a process to increase the security level of paper documents. Applied to the paper document is a transfer film or laminating film having a laser-sensitive layer, and a laser-induced marking is produced in the laser-sensitive layer, for example, by laser-induced bleaching, laser-induced colour change or laser-induced blackening. It is taught that respective individualization of the document can be effected by way of that laser-induced marking.

US-2008/0187851-A1 discloses the marking of a material with identifier marks. An optical brightener is incorporated in the material, and marking is performed by reducing the brightness of the material at a selected location by directing local heating to this location, the mark thus produced appearing with a darker shade than its environment in ultraviolet light. The marking is based on partial or complete destruction of the brightening effect of the optical brightener under heating. The disclosure is suitable for providing e. g. coated paper and board containing an optical brightener with identifier marks for preventing falsifications.

WO-02/101147-A1 discloses a security thread with an opaque layer on which signs, figures or characters have been generated by means of a laser light, before the insertion of the security thread into a paper substrate.

EP-1291827-B1 and its U.S. counterpart US-2004/0232691-A1 disclose a method for the customization of security documents. They teach laser marking of at least two materials superimposed on a substrate, each of the at least two materials having different resistances to laser. An example is given in FIG. 3, where a first layer of material having a high resistance to laser and a second layer composed of two materials having different resistances are deposited on a banknote, and laser marked with a serial number of the banknote. The banknote also includes the serial number printed in another corner, and additional security elements such as a silver coated strip on which the serial number is provided, and a logo. According to the descriptions, the disclosure also makes it possible to provide a security thread or strip with a marking. The marking can be provided by the thread or strip manufacturer.

EP-2284015-B1 discloses a security element having a reflective layer which, by means of laser radiation, is marked with visually perceptible marks in the shape of patterns, letters, numbers or images.

EP-2271501-B1 teaches laser treatment of security documents involving perforation and simultaneous marking using a laser. A paper substrate has a marking region with a laser sensitive substance, and a security element is present in the marking region. The security element is weakened by laser light in order to generate, simultaneously and at perfect register, weak lines in the security element and marks in the paper substrate by alteration of the sensitive substance.

WO-2013/037473-A1 teaches marking of the front and/or rear surface of a substrate, or of the interior of a substrate, with laser light. The surface of a cylinder which is in contact with the substrate is arranged to take up ablated particles, so that these ablated particles do not adhere to the substrate or a following substrate.

US-2012/0103545-A1 relates to the production of colored markings on a substrate using laser light, and teaches combining a material for forming a colored mark under laser irradiation, and an antitampering agent. The substrate can be a paper substrate used in a security document and/or a security article.

U.S. Pat. No. 4,462,867-A relates to the production of paper for security documents. A security strip is used that has regions that obstruct drainage more than other regions. The strip can be provided with a pattern by cutting the pattern into the strip by, for example, a laser beam. This cutting takes place prior to the insertion of the strip into the paper. U.S. Pat. No. 4,462,867-A also seems to mention, as a possible material for the strip, some kind of paper. However, in view of how the strip is intended to be inserted, it is not clear how this would be possible in practice: the strip is introduced into the paper furnish, and no reference is made to any means or measures for preventing the strip from disintegrating in this rather hostile surrounding, before reaching the area where the paper is being formed. In this kind of paper making machines, the paper furnish generally includes mostly water, and is rather turbulent in order to make sure that the fibres of the paper will extend into different directions, thereby making the paper reasonably resistant to traction not only in the machine direction.

US-2006/0145468-A1 D4 refers to the production of a security document with at least one tangible marking in the form of a relief structure, produced by laser.

SUMMARY

A first aspect of the disclosure relates to a method of providing a security document (such as, for example, an identity document, a banknote, or a blank for the production of a security document) with a security feature, said security document comprising a document substrate, said document substrate being a paper substrate. The security document further comprises a security element embedded in said document substrate, said security element comprising an element substrate, said security element further comprising a material sensitive to laser light. This material can, for example, be a metallic material, such as metal or a metal oxide, or a conductive polymer, such as polyaniline, or any other suitable material.

In accordance with the disclosure, the method comprises the step of directing laser light onto the document substrate so as to alter said material, so as to provide said security element with a detectable marking, preferably without substantially affecting the document substrate. That is, preferably, no holes or similar should be burnt in the document substrate due to this laser light, and the document substrate should preferably not be marked or substantially marked by said laser light. Especially, it is preferred that no marks visible to the naked eye should remain on the surface of the document substrate in correspondence with all or part of the marking. However, it is not excluded that also the document substrate be altered by means of laser, in portions remote from the area of the security element that is subjected to the laser treatment, or even in part of that area.

By means of the alteration of the material by laser light, the properties of the security element can be altered after insertion of the security element into the paper substrate of the security document. That is, the security document can be marked by directing laser light onto it and, more specifically, onto the document substrate and onto the material sensitive to laser light of the security element embedded therein. This has been found to involve important advantages. For example, it allows customization of a security document by marking the security element, for example, with a name, identity number, serial number, code, or other symbols or marks, after incorporation of the security element into the paper substrate of the security document. Thus, the paper substrate can be produced incorporating the security element, for example, at the paper manufacturers premises, and customization of the security element can be carried out at a later stage, using laser light. For example, a passport can be customized with the details of the owner when being issued, and banknotes can be customized by not only printing the serial number on the surface of the paper, but also—or alternatively—by marking the security element, such as a security band or strip embedded within the substrate of the banknote, with said serial number. This marking can take place at any stage of the process of manufacturing and editing/processing the security document, for example, during the manufacture of the paper document substrate with the security element embedded therein, or immediately or shortly after manufacture of the document substrate, and/or at a later stage, for example, before printing of the document substrate and/or during printing thereof and/or once the document substrate has been printed, and/or once it has been further adapted to form part of a security document, such as a passport blank or similar. That is, the marking can take place at any stage, from the moment at which the security element has been embedded in the document substrate until the final issuing of a security document such as a passport, and even at later stages. For example, a security document can be updated during its lifetime by adding further laser markings of said material sensitive to laser light.

A further advantage is that the marking of the security element can be carried out in register with the document substrate, for example, so that the marking of the security element is positioned in a pre-determined relation with a feature of the document substrate, such as a watermark within the document substrate, a printed marking on the surface of the document substrate—such as a portion of an image printed on the document substrate-, or a side or edge of the document substrate. This can be advantageous, as it allows the marking of the security element to be placed in a very specific position in relation to the document substrate, independently of the tolerances involved with the placement of the security element as such within the document substrate, as long as this is possible in view of the dimensions of the security element, such as the width of a security band. For example, if the security band has a width of about 10 mm, and if its position within the document substrate can vary, with respect to a desired reference position, with about +/−3 mm in the cross direction due to tolerances in the introduction of the security band in the paper and/or the cutting of the individual document substrates from a sheet or roll of security paper, it will always be possible to mark the security band with 2 mm large symbols within the security band, while assuring that said symbols are placed in a predetermined position from, for example, a side or edge of the document substrate.

The presence of the marked security element within the document substrate can be advantageous to protect the security element from wear and to make forgery more difficult.

The possibility of ensuring that the security marking is in register with the document substrate makes it possible to optimize the incorporation of further security features and elements into or onto the document substrate, without risking a non-desired interaction with the security marking of the security element, for example, due to accidental overlapping.

Also, ensuring that the security marking of the security element is in perfect or quasi perfect register with certain features of the substrate, such as printed markings or watermarks, can help to prevent doubts about the authenticity of the security document.

Obviously, in addition to the marking made after insertion of the security element into the document substrate, the security element may also comprise further security markings or security features, established prior to insertion of the security element into the document substrate.

It has been found that it is possible to make markings in a security element also after that it has been inserted or embedded into a paper substrate, for example, by removal, for example, by sublimation or ablation of metal or other materials forming part of the security element, for example, in the form of one or more layers on or in a non-metallic substrate. It has been found that this can be achieved without damaging or substantially damaging the paper document substrate. Different materials tend to absorb light or radiation differently, depending on the wavelength of the light or radiation. Thus, for example, a material forming part of the security element, for example, as a layer of a security element, can easily be ablated or sublimated by laser light without damaging the surrounding paper document substrate, if the material has a high absorbance of laser light at a wavelength substantially different from the wavelength(s) at which the paper substrate (substantially comprising carbon atoms) has a high absorbance. Thus, by adequately selecting materials and wavelengths, removal of the material sensitive to laser light can be achieved, for example by sublimation or ablation, without substantially damaging the paper document substrate. Thus, the laser can sublimate the material, such as metal, and thus eliminate part of the material originally part of the security element, such as a metal layer, without substantially affecting the paper document substrate and also without substantially affecting the substrate of the security element, which in some embodiments of the disclosure is also a paper substrate, or another kind of cellulose based substrate. The extent of the removal, for example, by sublimation or ablation, can depend on the way in which the laser is applied and also on the way in which the security element comprises the material, such as metal particles and/or a metal layer, and also on the characteristics of the paper document substrate and on the characteristics of the element substrate. However, the skilled person will not have any difficulties in tuning the laser treatment so as to achieve a desired marking of the security element, a marking that can be detected, for example, visually, by other optical means, magnetically, electromagnetically, or in any other way. For example, the marking can reside in leaving certain areas of the security element without the originally present metallization, thereby giving rise to a detectable code, which can be read, for example, optically or magnetically, as known in the art.

The marking can reside in the material, such as the metal, that is left after the laser treatment, or in the recesses in said material created by the laser treatment, or both. The marking can be in the form of symbols or images, such as alphanumeric symbols, barcodes, maps of points, maps of regular or irregular polygonal subareas, that can be detected, for example, visually, especially by transmission.

In some embodiments of the disclosure, the step of directing laser light onto the document substrate is carried out so as to substantially sublimate at least part of said material, so as to provide said security element with said detectable security marking.

In some embodiments of the disclosure, said material that is sensitive to laser light is a conductive and/or metallic material, for example, a metallic material in the form of metal or metallic particles. This option can be preferred as there are many processes for incorporating metallic particles into, for example, a cellulose based support. Metallic particles can be preferred as they are easy to sublime with laser light without damaging the paper, as the wavelengths appropriate for sublimating metal are generally different from the wavelengths for sublimating paper fibres, substantially comprising carbon atoms. In other embodiments of the disclosure, the material is a conductive polymer, such as polyaniline.

In some embodiments of the disclosure, said material, such as the metallic material or the conductive polymer, is present on and/or within the element substrate, for example, as a layer on one side of the element substrate. In some embodiments of the disclosure, the material can be in the form of particles, such as metal or metallic particles, deposited on one or both sides of the element substrate, and/or within the element substrate, for example, up to a certain depth of the element substrate. In some embodiments, the particles, such as metallic particles, can be deposited using printing techniques involving the use of an opaque ink or metallization techniques with deposition under vacuum. Also, the metal particles in the element substrate can be what is left after a demetallization process.

In some embodiments of the disclosure, the method further comprises the step of producing perforations or microperforations in the material and, optionally, also in the element substrate, after incorporation of said material onto or into said element substrate but prior to embedding the security element in the document substrate. This can be useful for establishing an adequate capillarity of the security element, thereby improving its integration with the paper document substrate. The perforations can be produced using laser light, so as to sublimate the material and, optionally, also the element substrate (such as a cellulose substrate, to be described below) containing and/or carrying said material, thereby completely perforating the security element and, thus, improving its capacity of becoming integrated with the paper document substrate. A suitable laser source can be one of the following ones: Fiber laser; Nd:YAG; Ho:YAG; Er:YAG; Tm:YAG; Organic dye; Excimer; and $CO_2$. Fibre laser, Nd:YAG and $CO_2$ are considered preferable. Wavelengths in the range of 100-11000 nm are preferred, and wavelengths in the range of 1000-11000 nm are more preferred. The laser spot diameter can typically be in the range of 0.01-1.000 mm, preferably 0.01-0.1 mm. The pulses can preferably have a duration in the range of femtoseconds to microseconds, more preferably in the range of nanoseconds to microseconds. The duration influences the thermal impact. The average power of the pulses, which influences the perforation speed, can preferably be in the range of 100-2000 W, more preferably in the range of 125-250 W.

In some embodiments of the disclosure, the security element is a strip or a patch. That is, the security element can have a substantially laminar structure, which can be continuous or with perforations, such as microperforations. The security element can be prepared starting with a laminar cellulose structure in the form of a web or sheet, which after being provided with the appropriate characteristics (for example, the material that is sensitive to laser light, any microperforations, etc., as described above) is cut into strips or patches having an appropriate width.

In some embodiments of the disclosure, the security element comprises (or the element substrate is) a cellulose substrate (for example, the security element can comprise a substrate in the form of a cellulose support web in line with the one disclosed in EP-1872965-A1), preferably a paper or cellophane substrate. An advantage involved with a cellulose substrate, that is, a substrate based on cellulose fibres, is that it tends to integrate well with the paper document substrate into which it is to be embedded, as explained in EP-1872965-A1. This can serve to reduce the thickness of the document substrate at the position of the security element, and can further make it more difficult to remove the security element without damaging the security document. It also contributes to make it possible to use security elements having fairly large dimensions, such as a fairly wide security strip or band, such as a strip having a width in the range of 5-250 mm, without jeopardizing the integrity of the paper document substrate into which the security element is embedded. The cellulose material of the cellulose substrate can comprise cellulose fibres of vegetal origin which have been processed by physical processes, such as the ones used to manufacture paper, or which have been processed by chemical processes, such as the ones used to manufacture cellulose acetate or cellophane.

In some embodiments of the disclosure, the cellulose element substrate is a paper based substrate that has been manufactured with wet strength resin in its pulp, to prevent the cellulose substrate from disintegrating when inserted into the document substrate, for example, when inserted between two wet paper layers, for example, two wet paper layers coming from respective cylindrical wire meshes of a paper making machine. The water contained in said layers tends to destroy the hydrogen bonds between the cellulose fibers, but not the covalent bonds between the wet strength resin and the cellulose fibres. It can be preferred that the cellulose element substrate contains only relatively small amounts of wet strength resin, just enough to prevent the cellulose element substrate from disintegrating or breaking during its insertion between the two wet paper layers.

The cellulose element substrate is preferably porous or very porous, with capillarity that facilitates the penetration into the cellulose element substrate of the liquid contained in the paper layers between which the cellulose element substrate is to be embedded. As the document substrate will also generally be manufactured with wet strength resin in the pulp, due to the capillarity of the cellulose element substrate, the fluids present in the wet layers of the document substrate, which contain such wet strength resin, can enter into the cellulose element substrate. The fact that the cellulose element substrate contains only relatively small amounts of wet strength resin implies that the cellulose fibres retain the capacity of creating new chemical covalent bonds with the wet strength resin originating from the pulp of the paper layers of the document substrate. Due to this capacity, and due to the infiltration of additional wet strength resin from the wet paper layers, new covalent bonds are created between the cellulose fibres of the element substrate and the wet strength resin contained in the wet layers, after inserting the element substrate, when the wet strength resin is cured or activated during the process of drying the paper. This provides for an enhanced integration of the element substrate with the document substrate.

When the security element comprises a cellulose paper substrate, this substrate can be obtained through conventional paper manufacturing processes, in which vegetable-origin cellulose paper fibres are mechanically processed in order to form a cellulose pulp, and in which chemical agents, dyes and mineral fillers are added to said pulp, whereafter the pulp is subjected to sheet forming, pressing and drying processes in paper machines, followed by sizing to achieve a desired printing capacity. Preferably, to allow for an adequate integration of the element substrate in the paper document substrate, the element substrate made out of cellulose should have certain characteristics, such as the following ones:

The width of the element substrate, which can influence its capacity of being embedded, can typically be in the range of 5-250 mm, preferably 10-35 mm.

The thickness of the element substrate may also affect its capacity of becoming embedded. A suitable thickness can be in the range of 33-66 microns, preferably 44-55 microns.

A good capillarity can be preferred. For example, the element substrate can preferably feature a Bendtsen porosity (×4 sheets)>2000 ml/minute, preferably >2500 ml/minute.

For embedding purposes, a basis weight of the element substrate of 15-30 $g/m^2$ can be preferred, and a basis weight of 20-25 $g/m^2$ can be more preferred, especially when the document substrate has a basis weight in the range of 70-110 $g/m^2$; this is considered to provide for a suitable capillarity in the case of cellulose substrates, and a suitable proportionality to the thickness of the document substrate.

In spite of the fairly low thickness and basis weight of the element substrate, the tensile strength of the element substrate should be adequate in order to avoid breaks during embedding. It is considered that adequate values may be in the following ranges:

Dry Tensile Strength:

Machine direction (MD): 20-35 N/15 mm, preferably 25-30 N/15 mm

Cross direction (CD): 8-25 N/15 mm, preferably 10-20 N/15 mm

Wet Tensile Strength:

Machine direction (MD): 0-5 N/15 mm (or 0.1-5 N/15 mm), preferably 0-2 N/15 mm (or 0.1-2 N/15 mm)

A low wet tensile strength can be useful to improve or facilitate the adaptation of the cellulose fibres of the element substrate to the layers of the paper document substrate into which the element substrate is to be embedded. For example, a cellulose element substrate can include a rather small proportion of wet strength resins, just enough to prevent the substrate from disintegrating when embedded between wet paper layers coming from the papermaking machine. During the process of embedding, when the element substrate meets the layers that form the paper document substrate, or the layers that when joined will form the paper document substrate, these layers still contain substantial amounts of water in the area where the element substrate meets the paper layers. Also, the wet strength resins contained in said layers and that generally enhance the wet tensile strength have not yet been activated, as the paper layers recently formed on the cylindrical wire meshes have not yet been subjected to the pressing and drying steps. At this stage, the porosity and capillarity of the element substrate provide for improved penetration into said substrate of the liquids contained in the wet paper layers, including the wet strength resins of said paper layers. This helps to enhance integration between the paper document substrate and the element substrate.

When the element substrate is a cellophane or cellulose acetate substrate, it can be obtained through conventional cellophane or cellulose acetate film manufacturing processes, in which cellulose fibres of vegetal origin are treated with acetic acid and anhydride in order to form a tri-acetate pulp which turns into cellulose acetate after a partial hydrolysis of the tri-acetate suspended in an aqueous acid solution. During a drying process, the cellulose acetate granulates. Finally, the granules are heated to melt and then laminated, thus obtaining a transparent laminar film, which is water-permeable, flexible and not thermoplastic. Such a laminar film can be useful as an element substrate to be embedded in a paper document substrate, for example, in the form of a security strip or band.

For compatibility with the insertion process, it is considered to be appropriate that the cellophane-based element substrate has the following features:

A width in the range of 5-250 mm, preferably 10-35 mm.

A thickness in the range of 10-40 microns, preferably 15-25 microns.

A dry tensile strength as follows:

MD: 20-35N/15 mm, preferably 25-30 N/15 mm

CD: 8-25 N/15 mm, preferably 10-20N/15 mm

The material that is sensitive to laser light can preferably be in the form of particles, such as metal particles, which can be added to in the mass and/or onto the surface of the element substrate.

In the case of a cellulose paper element substrate, the particles can, for example, be added at the stage in which the mineral fillers are added.

In the case of a cellophane or cellulose acetate substrate, the particles can, for example, be added once the acetate granules have been obtained, and mixed with the granules during the process.

In both cases, incorporation of the particles onto one or both of the surfaces of the element substrate can be achieved by, for example, printing processes which include these metallic particles, or, in the case of metal or metallic particles, by metallization processes with vacuum deposition.

The particles should have an adequate sublimation capacity. For example, metals and metal oxides can be used, preferably but not exclusively aluminium, nickel, copper, iron, tungsten or cobalt. Also conductive polymers, such as polyaniline, can be used.

If a printing process is used, the following parameters may be preferred:

Carrier (the choice of carrier influences the printing quality and the anchoring of the metal particles to the substrate): opaque and reflective ink.

Printing technique (the choice of printing technique can influence the distribution and thickness of the printed layer): heliogravure, silkscreen, offset; heliogravure may be the most preferred one.

The thickness of the printed layer (this influences the volume of the applied particles): 0.1-5 microns, more preferably 0.5-1 micron.

Linework (the choice of which influences the distribution and thickness of the printed layer): 10-80 lines/cm, more preferably 24-32 lines/cm.

Also, conventional metallization processes can be used.

The use of a cellulose based element substrate, such as a paper or cellophane/cellulose acetate substrate, involves advantages over the traditional metal or polymer (such as polyester or polypropylene) substrates, due to the chemical compatibility with the paper document substrate. However, when metallic particles or other particles are incorporated onto the surfaces and/or into the cellulose based substrates, the capillarity can be reduced, which may negatively affect the way in which the element substrate will be embedded in and integrated with the paper document substrate. In order to maintain or restore, as far as possible, an adequate level of capillarity so as to promote a correct embedding, it can be preferred to carry out a perforation or micro-perforation of the element substrate once the particles of the material that is sensitive to laser light have been incorporated, as described above. If desired, these microperforations can be made so small that they will not be visible to the naked eye, neither by reflection nor by transmission.

The document substrate is a paper substrate which preferably can feature certain parameters to facilitate an appropriate embedding of the cellulose security element. The document substrate can, for example, have a basis weight of 70-110 g/m$^2$, more preferably 80-90 g/m$^2$, and a thickness of 85-132 microns, more preferably 96-108 microns. For enhanced optical visibility, the opacity of the document substrate can preferably be in the range of 80%-98%, more preferably 90%-94%. The paper of the document substrate can preferably be made up of 2-4 layers, more preferably 2 layers, whereby the security element can be inserted between two of these layers. The paper manufacturing speed, which will affect the tension on the element substrate during insertion of the element substrate into the document substrate, can for example be in the order of 40-100 m/minute, more preferably 50-65 m/minute. Insertion of a cellulose security strip into a paper substrate is discussed in EP-1872965-A1, and the teachings of this document can be applied to the present disclosure.

Under these conditions, it is possible to guarantee a suitable insertion of the cellulose strip between two paper layers that will form the document substrate, at a moment when the respective paper layers are already formed and heading to the pressing and drying processes, leaving the wire meshes of the paper machine. In this way, the cellulose strip will become integrated in the document substrate without producing a substantial increase in the thickness of the document substrate where the element substrate is positioned, due to the physical-chemical interactions generated between the document substrate and the element substrate, which are basically due to the capillarity of the cellulose element substrate. However, despite this substantial integration, both the document substrate and the element substrate remain as different physical entities, that is, the element substrate does not generally "disintegrate" and disappear within the document substrate, and it can be observed as a substantially independent element in, for example, a cross-section of the document substrate.

This is a difference if compared to conventional security threads of, for example, synthetic polymeric substrates such as polyester or polypropylene substrates, which are generally non-porous and impervious and lack capillarity; thus, such substrates will not become integrated with the cellulose of the document substrate. When a conventional impervious security strip is inserted into the paper document substrate during its manufacture, the cellulose fibres of the document substrate simply accumulate above and below the security strip, which implies that the thickness of the document substrate will be increased at the position of the security strip: there is no integration between the security strip and the document substrate, but a mere yuxtaposition of the cellulose of the document substrate and the material of the security strip. This is the reason for why, in the manufacture of substrates that will be stacked on each other when in use, such as for example in the manufacture of substrates for banknotes, the security strip is generally fed so that its position in the cross direction will be different in different substrates, whereby the security strip will not be in register with, for example, the lateral edges or the print of the banknote, that is, the relation between the position of the security strip and, for example, an edge of the banknote, or a printed element on the banknote, or a watermark in the banknote, will not be the same for all banknotes of the same kind. Also this drawback can be avoided when using a cellulose substrate for the security element.

Also, as the cellulose security element does not substantially add to the thickness of the document substrate in the area in which the security element is present in the document substrate, the document substrate can be processed, such as printed and cut, just as if the security element had not been incorporated. This simplifies the production of the final security document.

In some embodiments of the disclosure, the detectable security marking is visible by transmission but not by reflection. For example, a marking in the form of recesses in a metal-carrying area of the security element embedded in a paper substrate is often visible by transmission, but not by reflection; at least, such recesses are far more visible by transmission than by reflection, as known in the art; the marking can be such that it can be detected by optical detectors, for example, in a way so as to provide a predetermined response by an electronic verification system. In some embodiments of the disclosure, said detectable security marking is detectable using magnetic detectors. The sensitivity can be controlled by appropriately selecting the material, for example, by using metallic particles have high or low coercivity.

When the presence of the remaining material in the element substrate is discontinuous, for example, screen-like, the recesses obtained by the laser treatment can optionally be totally or partially surrounded by a line, such as a thin and/or continuous line, which makes it easier to observe the shape of the recesses, as taught by EP-1652687-A1.

In some embodiments of the disclosure, the detectable security marking is made in register with a feature of the document substrate. For example, in some embodiments of the disclosure, the detectable security marking is made in register with a marking on or within the document substrate, such as a mark or other feature printed on the document substrate, or a watermark within the document substrate. In some embodiments of the disclosure, the detectable security marking is made in register with a side or edge of the document substrate.

In some embodiments of the disclosure, the detectable security marking is used to customize the security document. In some embodiments of the disclosure, the detectable security marking is selected to identify an owner of the security document. For example, the security marking can comprise the name of the owner, or an image of the owner, or a code indicative of biometric data of the owner, etc.

In some embodiments of the disclosure, the element substrate can include, on one or both of its surfaces, either continuously or discontinuously, overlapping or not with those areas with the material to be altered such as sublimated by the laser light, an adhesive lacquer which is activated with temperature and/or humidity, and which increase the binding between the element substrate and the surrounding document substrate, thereby making extraction of the security element more difficult.

Another aspect of the disclosure relates to a security document comprising a document substrate, said document substrate being a paper substrate comprising at least two paper layers, said security document further comprising a security element embedded in said document substrate between said paper layer, said security element comprising an element substrate in the form of a cellulose strip or patch. In accordance with this aspect of the disclosure, the element substrate is provided with a material that is sensitive to laser light, for example, with metal or metallic particles arranged in at least one layer on or within the element substrate, or dispersed throughout said element substrate. The material is arranged so that said material can be sublimated with laser light, so as to provide said security element with a detectable marking due to partial sublimation of said material with laser light. The fact that the security element is embedded between two layers makes it possible to embed the security element after that the respective layers come out of the paper making machine, thereby avoiding or at least reducing the risk for damage to, or disintegration of, the security element during embedding, a risk that is very serious when the security element has a cellulose substrate and is inserted into the paper furnish, cf. our above discussion regarding U.S. Pat. No. 4,462,867-A1. This risk can be avoided or substantially reduced if the security element is fed in between the two layers once they have left the slurry of the paper making machine. Joining of the two layers can take place as known in the art.

Another aspect of the disclosure relates to a security document, comprising a document substrate, said document substrate being a paper substrate, said security document further comprising a security element embedded in said document substrate, said security element comprising an element substrate in the form of a cellulose strip or patch. In accordance with this aspect of the disclosure, said element substrate is provided with a material sensitive to laser light, for example, metal or metallic particles arranged in at least one layer on or within the element substrate, or dispersed throughout said substrate. The security element is provided with a detectable marking due to partial sublimation of said material with laser light.

Another aspect of the disclosure relates to a security document, obtained or obtainable with the method of the first aspect of the disclosure.

As indicated above, the detectable marking is produced using laser light. A laser can be used operating at a wavelength or at wavelengths suitable for removal, by ablation/sublimation, of the material sensitive to the laser light, such as metal, but which is not affecting the material of the paper document substrate. The marking can be carried out so that the laser sensitive material, such as metal particles, is sublimated and thus removed, without damage being caused to the paper document substrate or the element substrate. Also, the print on the document substrate can remain intact, that is, no inks or similar are removed.

When the material sensitive to laser light comprises metal particles to be removed by sublimation, the following laser sources can be preferred to produce the sublimation: Fibre laser; Nd:YAG; Ho:YAG; Er:YAG; Tm:YAG; and $CO_2$. Of these, Fibre laser, Nd:YAG; and $CO_2$ are more preferred. For the sublimation of metal particles, wavelengths in the range of 1000-11000 nm are preferably used. The pulses can preferably have a duration in the range of femtoseconds to microseconds, more preferably in the range of nanoseconds to microseconds. The duration influences the thermal impact. The average power of the pulses, which influences the sublimation speed, can preferably be in the range of 100-2000 W, more preferably in the range of 125-250 W.

Thus, the method of the disclosure makes it possible to mark printed security paper with symbols, characters, figures or codes which remain located inside the security paper. Thus, a printed security document can be provided with additional information or security features which cannot be removed, deactivated or modified without destroying or invalidating the document itself.

Besides, the use of laser light to produce the marking makes it possible to obtain a very high accuracy in the position of the marking and in the details of the marking, using commercially available laser equipment. This also reduces the tolerances in the positioning of the marking and allows for an increase in the number of security elements that can be incorporated in the security document.

Depending on the graphical design of the marking, in addition to the possibility to visually detect the marking, it is possible to generate codes with hidden information, only detectable with image inspection devices or specific readers. Such codes include barcodes or dots matrixes.

On the other hand, if the metallic particles which remain in the document after sublimation are also magnetic or, more generically, yielding responses within the electromagnetic wave spectrum when subjected to specific stimuli, it is possible to add an additional property to be detected during an authentication process, using suitable detectors. This allows to even further increase the security level.

In some embodiments of the disclosure, a security element can be treated with laser light to provide perforations prior to inserting said security element into a document substrate, for example, for the purpose of enhancing the porosity or capillarity of the substrate by means of said perforations.

BRIEF DESCRIPTION OF THE DRAWINGS

To complete the description and in order to provide for a better understanding of the disclosure, a set of drawings is provided. Said drawings form an integral part of the description and illustrate some embodiments of the disclosure, which should not be interpreted as restricting the scope of the disclosure, but just as examples of how the disclosure can be carried out. The drawings comprise the following figures.

DETAILED DESCRIPTION OF THE DRAWINGS

Figure 1A:
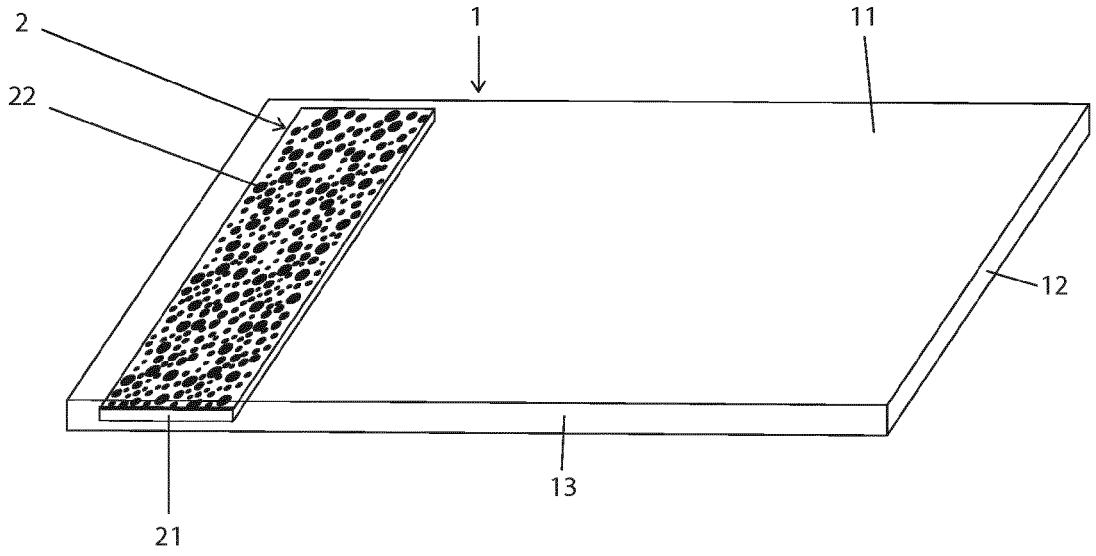
FIGS. 1A and 1B are schematic perspective views illustrating document substrates containing element substrates, in accordance with two embodiments of the disclosure.

FIG. 1A is a perspective view of a portion of a security document 1, such as a banknote or banknote blank, or a paper to be used to manufacture a passport, or part of a passport blank. The document comprises a document support 11 of paper, and a security element 2 embedded in the paper 11. The security element comprises an element support 21 in the form of a paper strip, covered with a layer of metal particles 22 which penetrates into said paper strip. The security element 2 extends in the machine direction throughout the document support 11, from one of the longer sides 12 to the opposite one of the longer sides of the document support 11, in parallel with the shorter sides 13 of the security support, one of which is shown in FIG. 1A. The document support may be printed, but the print is not shown in FIG. 1A, for simplicity.

Figure 1B:
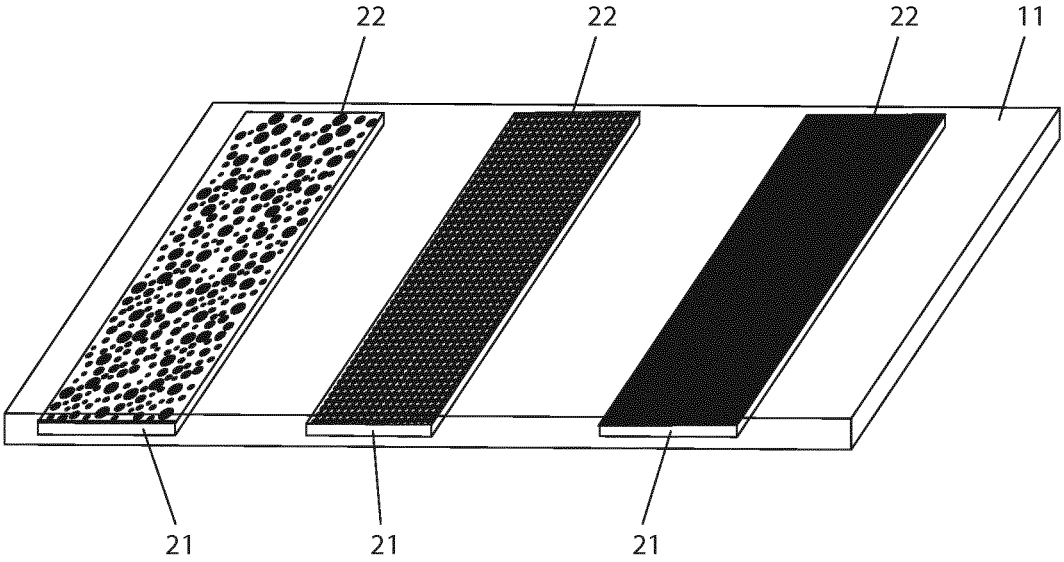

FIG. 1B schematically illustrates a different example of a security document support, in this case with three different security elements, one having a layer of randomly distributed metal particles, another one having a screen-like metal layer, and one comprising a compact metal layer. The layers, such as the compact metal layer, can optionally be perforated, such as with microperforations, to enhance capillarity. Also, for example, if the element substrate is a cellophane substrate, advantageously also the substrate is provided with perforations, to enhance capillarity.

Figure 3A:
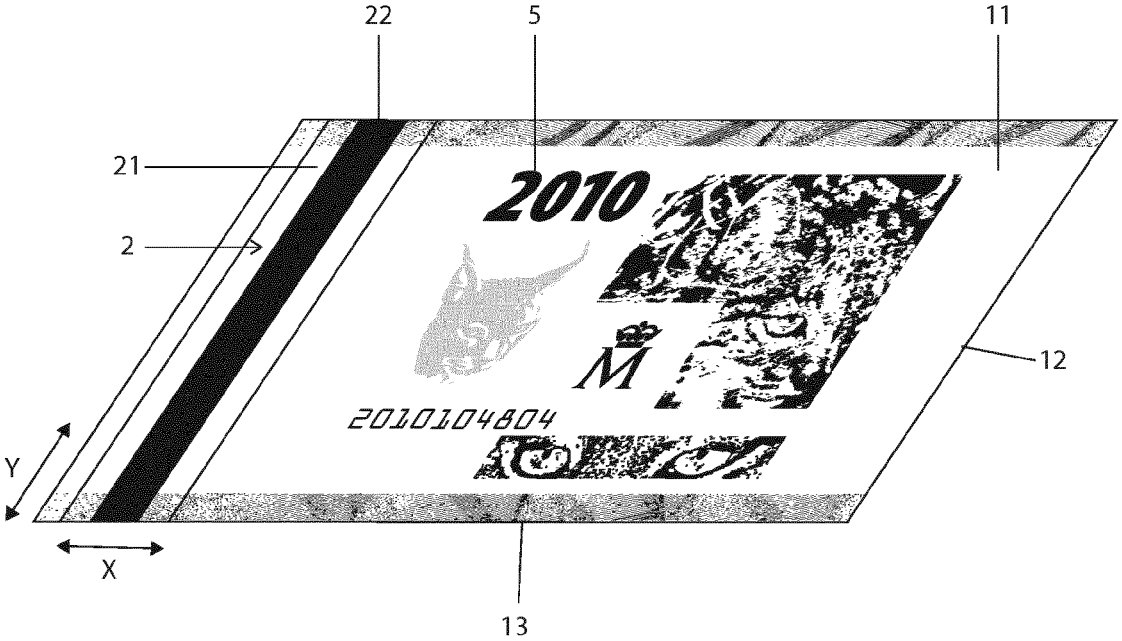
FIGS. 3A and 3B are schematic perspective views illustrating a process sequence in accordance with an embodiment of the disclosure.

FIG. 3A is a top view of a security document, such as a banknote. The security document substrate 11 is a rectangular sheet having two shorter sides 12 and two longer sides 13. Embedded within the rectangular paper sheet is a security element 2, comprising a cellulose element substrate 21 partially covered with a metal layer 22. The security element has been inserted into the document substrate 11 during the manufacture of the paper sheet. For example, a large paper sheet or web can be manufactured in which several security strips 2 are inserted in parallel, and said larger sheet or web can then be cut to produce the individual document support. Due to the tolerances in the process of insertion of the security strips 12, and due to the tolerances in the cutting, the position of the security element 2 can vary in the X direction, that is, in the so-called cross direction, parallel with the longer sides 13. Thus, the security element as such may not be in perfect register with, for example, the shorter sides 12 or with matter printed on the document substrate, for example, printed symbols 5 (such as digit "2" in FIG. 3A). However, when applying the laser light to create the markings 3 (the numbers shaped by the recesses in the metallic layer 22 of the security element 2) as shown in FIG. 3B, this laser marking can be carried out to make sure that these symbols be in register with, for example, the short side 13 of the document substrate, and/or with the matter 5 printed on the document substrate, or with a watermark within the document substrate, etc., irrespective of a certain misalignment of the security strip 2 as such in the "X" direction, especially as the width of the security strip is large enough to allow for the marking of the numbers even if the security strip is slightly displaced in the "X" direction.

The same applies to the alignment of the marking 3 of the security element in the Y direction, that is, the machine direction: as the addition of the marking 3, that is, the serial number, to the security element 2 takes place after insertion of the security strip 2 into the document substrate 11, it is possible to make sure that the digits of the serial number are placed correctly also in the "Y" direction, that is, in the axial direction of the security strip 2. This can be more difficult to achieve when a pre-marked security thread is inserted into a document substrate.

Figure 3B:
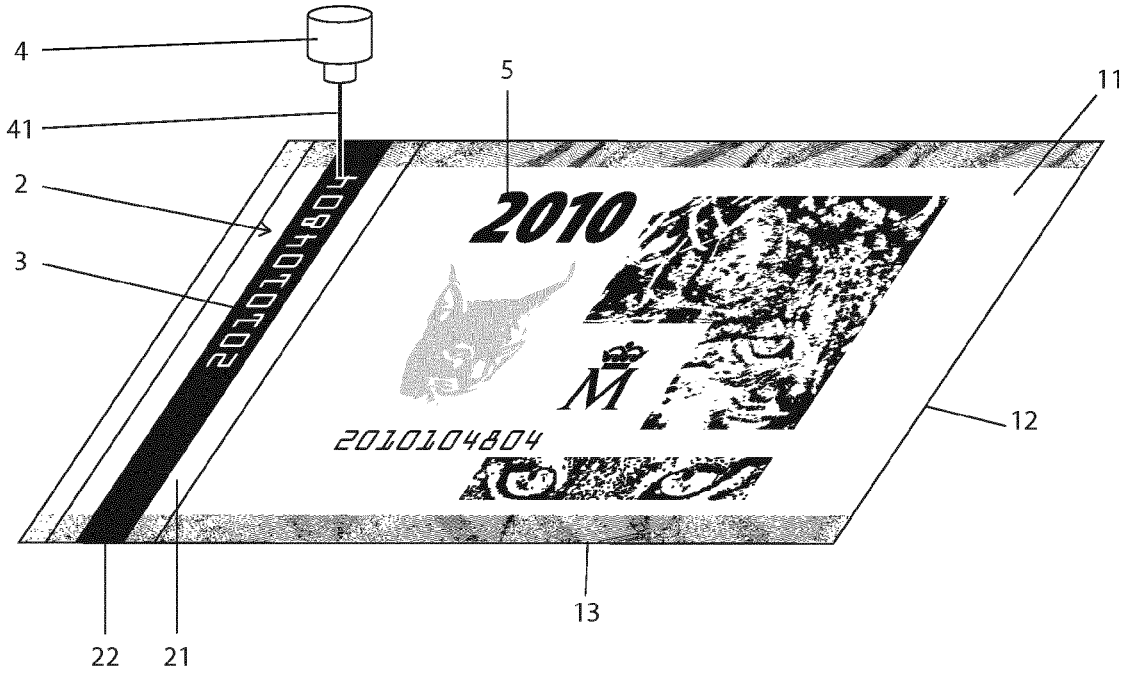

FIG. 3B schematically illustrates how a laser source 4 is used to generate and direct a beam of laser light 41 towards the document support 11 and the security element 2. The laser light is projected onto the layer of metal particles 22 and sublimates the metal particles along the path scanned by the laser light beam, thereby creating recesses in said layer of metal particles 22. It can be seen how a marking in the form of series of recesses 3 shaped as digits has been established in the security element 2 embedded in the paper of the document support 11. Neither the document support 11 nor the element support 21 have been damaged, so the element support 21 is still embedded in the paper of the security support. The recesses 3 can easily be observed by transparency, but are not readily visible by reflectance, just as in the case with conventional security strips of the kind that, already before insertion into the document substrate, are provided with symbols/characters in the form or recesses in an opaque layer. In accordance with some embodiments of the disclosure, the recesses 3 can be placed in register with the sides of the document support 11, or in register with a feature printed on the surface of the document support, or in register with a watermark within the document support, etc.

Figure 4A:
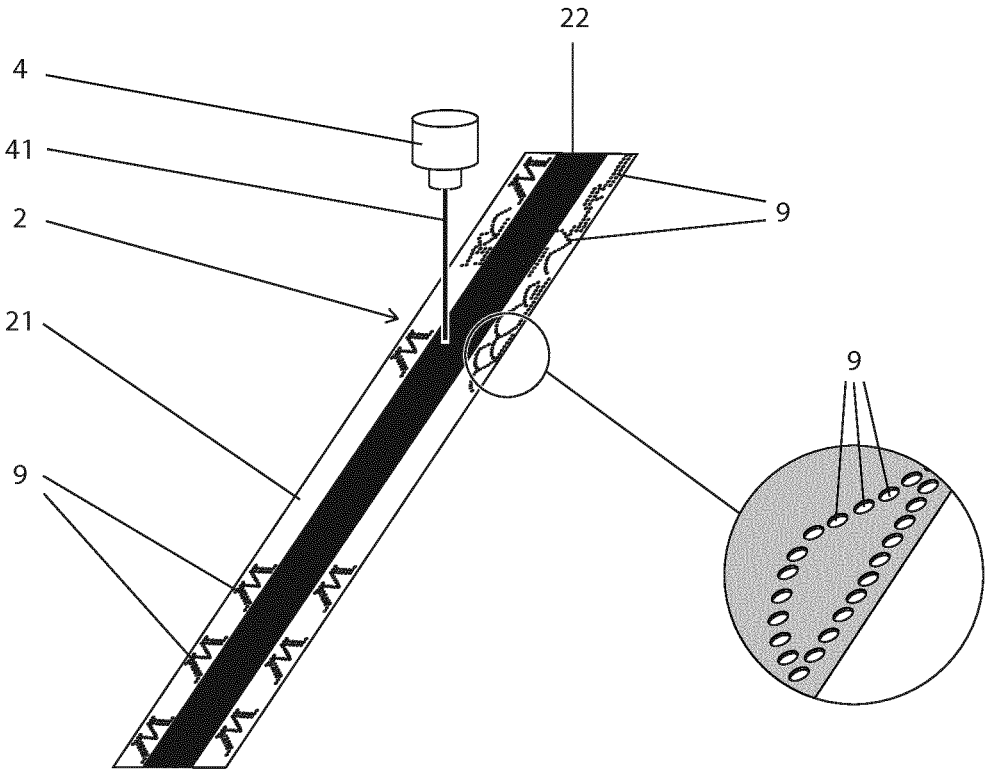
FIGS. 4A-4C are schematic perspective views illustrating a process sequence in accordance with another embodiment of the disclosure.
Figure 4B:
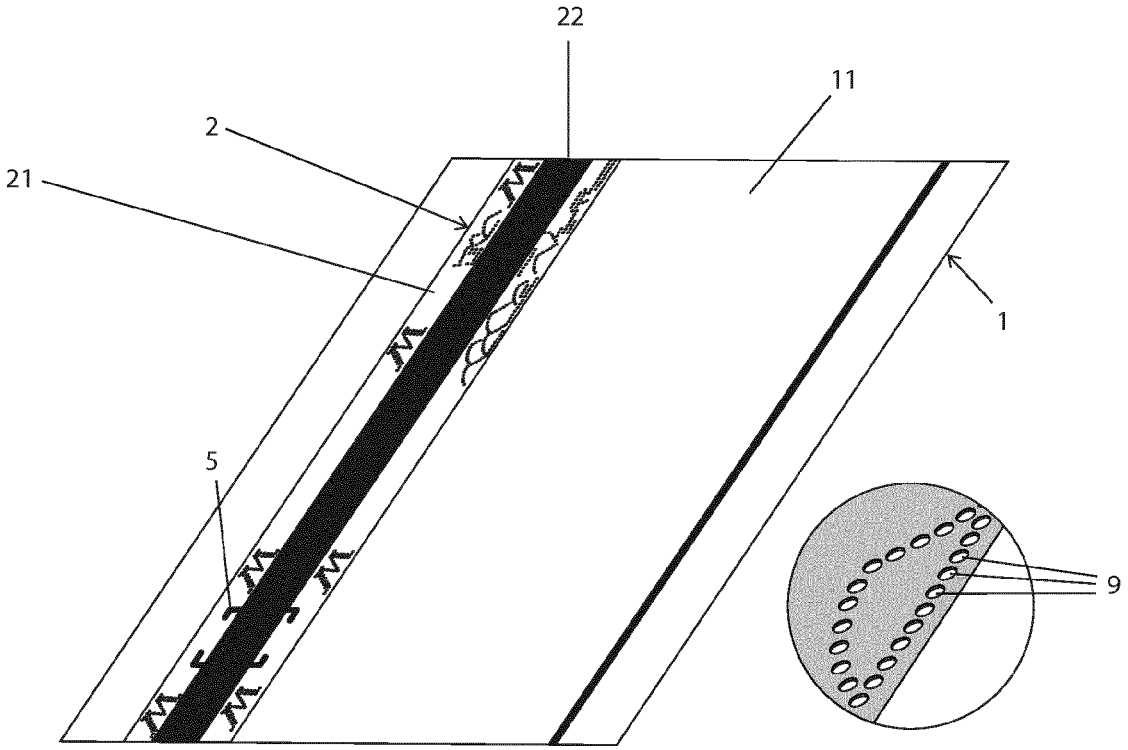
Figure 4C:
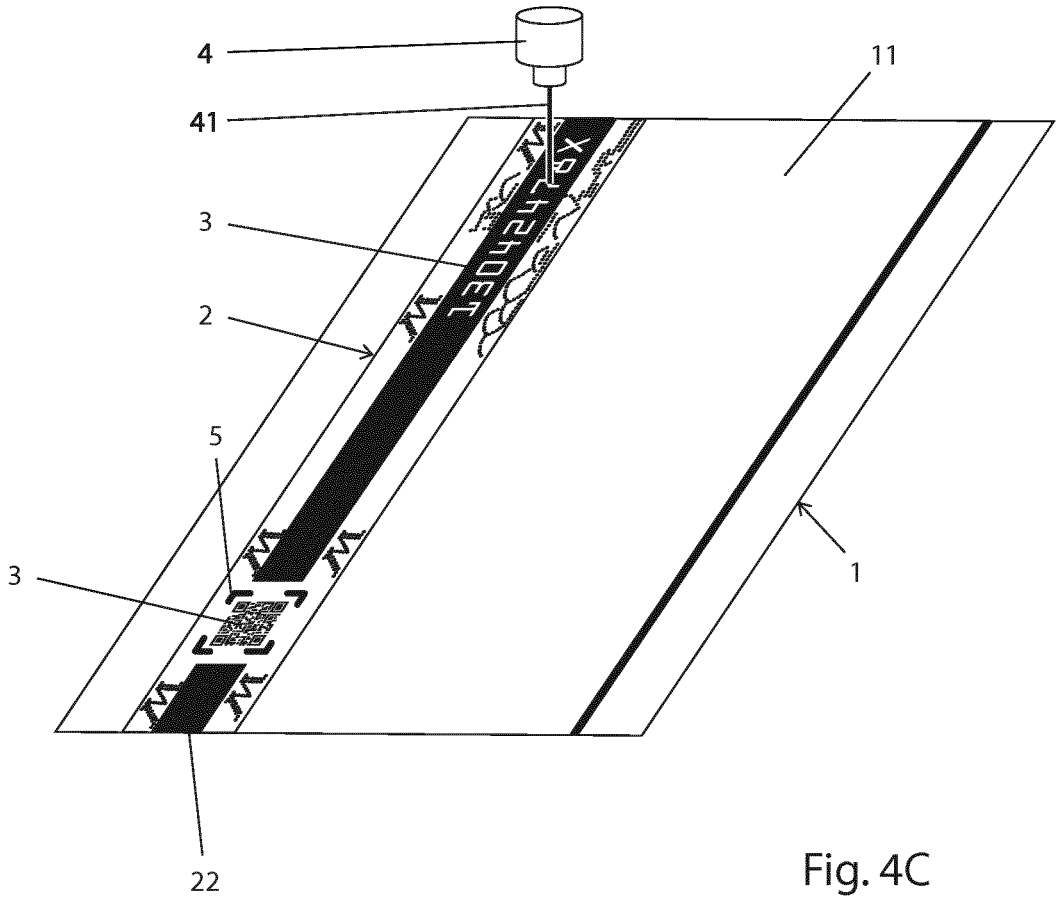

FIGS. 4A-4C illustrate another embodiment of the disclosure. FIG. 4A illustrates a security element 2 comprising a cellophane element substrate 21 with a metal layer 22. The cellophane substrate has been treated with laser light to create a plurality of perforations 9 to enhance capillarity so as to facilitate integration with the document substrate.

In FIG. 4B, this security element 2 has been embedded in a paper document substrate 11, and a security document 1 has thus been formed, which in addition includes one or more printed symbols 5. When a passport is to be issued to a specific owner, and the owner's personal and biometric data are known, a QR dot code can be generated on the basis of the biometric data, and this code and other symbols 3 specific to the owner can be introduced in the security element by sublimating part of the remaining metal layer, as illustrated in FIG. 4C, where the QR dot code 3 is placed in register with the symbols 5 printed on the paper document substrate 11.

The disclosure can, for example, be carried out in accordance with the following examples:

EXAMPLE 1

Production of a Banknote Customized with a Serial Number.

1A.—Manufacture of the Security Element:

A suitable paper bobbin can be obtained from Papelera de Brandia, S. A., in accordance with the following specifications: basis weight 22 g/m$^2$, thickness 48 microns, Bendtsen porosity (×4 sheets) 2600 ml/min, dry tensile strength 28N/15 mm and 17N/15 mm (machine direction and cross direction, respectively).

This bobbin can subsequently be printed in a heliogravure printing machine manufactured by Giave, endowed with a printing cylinder manufactured by Artcyl and engraved by Ziraba. A suitable ink can be obtained from SICPA, with a viscosity of 32 s CP4 and containing aluminium metallic particles. The printing cylinder can be chemically engraved with a 36 lines/cm screen and a 34-micron cell depth with blocks so as to print, on the paper bobbin, 8 mm wide printed longitudinally continuous strips separated in the cross direction so that the distance in the cross direction between the centers of adjacent strips is 18 mm. This can be carried out with a machine speed of 80 m/min, a drying tunnel temperature of 45° C. and a winding tension of 150 N. Under these conditions, a 0.6 micron thick layer can be obtained in the printed area. Once the bobbin has been printed, it can be cut into 18 mm wide strips which can be wound on independent reels.

Figure 2:
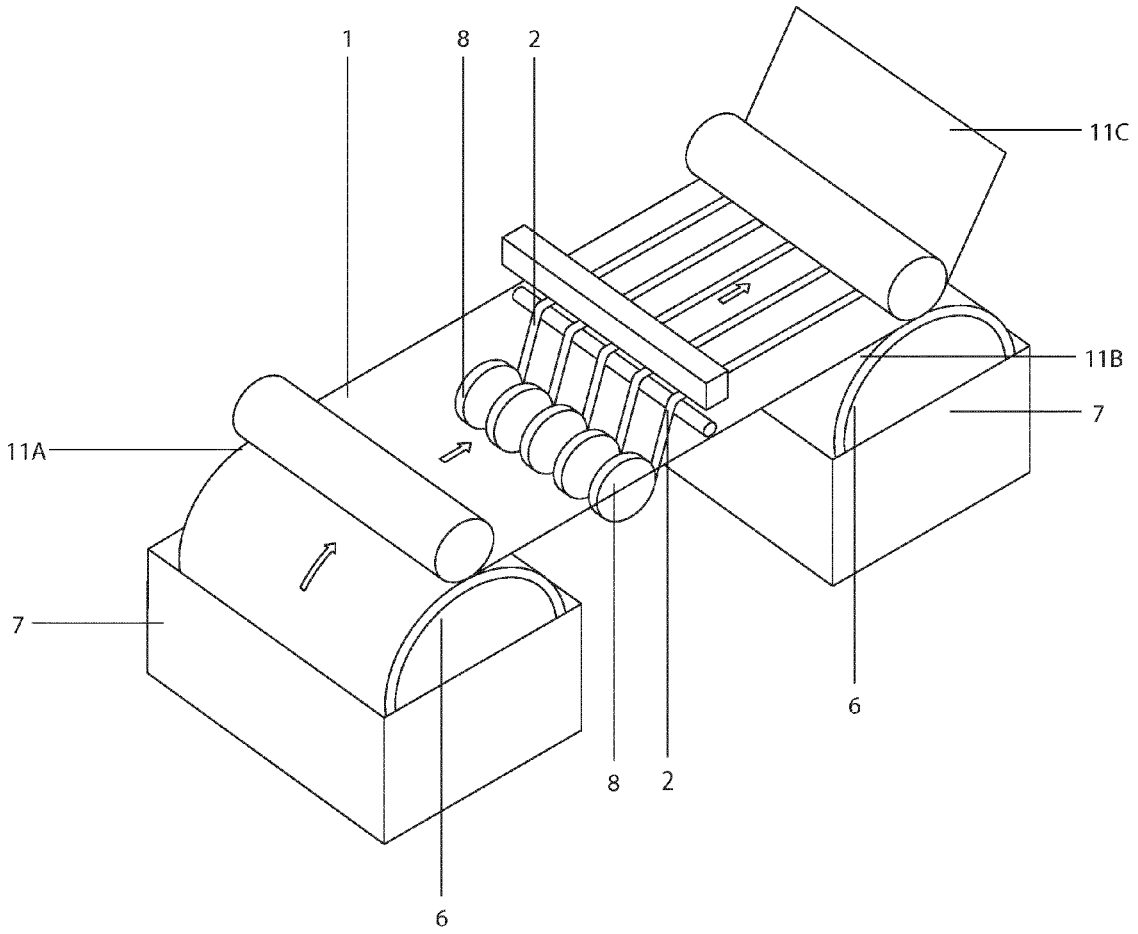
FIG. 2 schematically illustrate the insertion of cellulose strips into a paper, during the paper manufacturing stage, in accordance with a possible embodiment of the disclosure.

1B.—Manufacture of the Document Substrate with Incorporation of the Security Element:

A conventional paper machine with two cylindrical wire meshes 6 as shown in FIG. 2 can be used, together with an aqueous dispersion 7 of bleached and refined cellulose fibres. The paper machine can be adapted to manufacture a two-layer 11A and 11B security paper at a speed of 75 m/min to obtain a paper 11C with the following characteristics: basis weight 90 g/m$^2$, thickness 95 microns, opacity 80%. The cellulose strips making up the security elements 2 are embedded between the two layers 11A and 11B, as shown in FIG. 2. The unwinding of the reels 8 with the cellulose strips making up the security elements 2 has to be carried out appropriately to achieve a correct embedding of the security elements 2. For example, the strips can be propelled with 1.75 bar compressed air so as to approach the strips up to 8 mm with respect to one of the two layers of the paper, whereafter contact take place automatically. Once the adhesion of the security element 2 between the two paper layers 11A and 11B has been achieved due to the phenomena of capillarity and transfer of fluids from the cellulose pulp, the tension in the security element strip is maintained at the same unwinding speed as the paper layers 11A and 11B, and with a 0.3 bar propelled air pressure to maintain the strip suspended in the air. Under the described conditions, it is not necessary to microperforate the security element prior to insertion, in order for it to be correctly embedded, as the printed metal strips are not very wide, and as the print does not eliminate the porosity of the paper, so that the strips continue to feature a sufficient capillarity.

The obtained roll of security paper can subsequently be cut longitudinally and transversally in order to obtain paper sheets which can be used to print banknotes. These paper sheets can be configured with 5 cellulose security elements, embedded without increasing the paper thickness where they are embedded, and distanced, for example, 160 mm from each other.

1C—Manufacture of a Banknote Using the Security Paper:

The paper sheets can be printed in silkscreen, intaglio, offset, etc. printing machines, and provided with backgrounds, images, numbers and details typical of a banknote design.

Then, they can be subjected to the laser treatment of the disclosure. A Notamark machine can be used, manufactured by the company KBA-Giori, with a two-axis head with a Nd:YAG laser source which emits a 1060 nm pulsed laser light beam with an average power of 125 W and a 0.2 mm spot diameter. Under these conditions, the printed sheets can be processed at a speed of 10,000 sheets per hour and 40 banknotes per sheet. The laser radiation produces a sublimation of the metallic particles contained in the security element, producing a marking 3 in the form of recesses in the metal layer, recesses that correspond to the serial number of each banknote, such as 13 OCR numbers having a height of 2.8, as schematically illustrated in FIG. 3B. These recesses can be observed as lighter portions against a darker background when the banknote is held against a light, that is, when viewed by transparency; the darker background corresponds to the part of the metal particle layer that has not been sublimated by the laser source. The numbers can thus be observed by transparency in clear contrast with the rest of the surrounding 8-mm block on each banknote. As explained above, the numbers can be placed at a specific position; an example of a banknote obtained in this manner is shown on FIG. 3B. The banknote has a shorter side 12 and a longer side 13, and comprises a paper substrate 11 which has been printed with different symbols 5, and which contains, embedded within the substrate, the security strip 2 with the numbers 3 obtained by sublimating the metal layer, as described above.

EXAMPLE 2

Production of a Passport with a Number and an Internal QR Code Including Biometric Data of the Owner.

2A.—Manufacture of the Security Element with Metallic Particles:

The starting material can be a cellophane or cellulose acetate film bobbin manufactured by Coopercel; the film can have a basis weight of 30 g/m$^2$ and a thickness of 22 microns. This bobbin can subsequently be metallized on 100% of its surface with aluminium particles in a Leybold Optics ProM 1300 machine at a speed of 12 m/s and a pressure of $4\times10^{-4}$ mbar. Under these conditions, a layer thickness with an optical density of 2.1 is obtained. The metallized film can subsequently be microperforated regularly with an Nd:YAG laser source adjusted at a wavelength of 10,000 nm and a power of 250 W, producing circular holes with a diameter of 0.2 mm and placed at a distance of 2 mm from each other, and with a staggered configuration. Once metallized, the bobbin can be cut longitudinally into 18 mm wide strips which can be wound in independent reels.

2B.—Manufacture of the Document Substrate with Incorporation of the Security Element:

A paper machine as described in Example 1 can be used. The paper machine can be adapted to manufacture a two-layer security paper at a speed of 85 m/min with the following characteristics: basis weight 85 g/m$^2$, thickness 90 microns, opacity 80%. The insertion of the security element between the two layers of the paper can be carried out as suggested in FIG. 2. A device for the unwinding of the reels containing each security strip can be used in order to obtain the correct embedding of the security element. The strips can be propelled with 1.50 bar compressed air so as to approach the strips up to 8 mm with respect to one of the two layers of the paper whereafter contact takes place automatically. Once the adhesion of the security element between the two paper layers has been accomplished due to the phenomena of capillarity, transfer of fluids from the cellulose pulp and the dryness of the security element, the tension in the security element can be maintained at the same unwinding speed of the substrate manufacturing speed and with a 0.3 bar propelled air pressure to maintain the strips suspended. The obtained roll of security paper can subsequently be cut longitudinally and transversally in order to obtain the paper sheets out of which the passport blanks can be manufactured. The sheets can be configured with 6 cellulose strips embedded without increasing paper thickness in the area in which they are embedded, and positioned according to the desired layout of the pages of the passport 2C.—Passport Manufacture:

The paper sheets obtained in the previous step can be printed in a conventional manner, using silkscreen, intaglio, offset, etc. printing machines, with which the backgrounds, images, numbers and details typical to a passport design can be printed. Passport blanks can be produced and delivered to the authority or organization in charge of issuing the passport.

When a passport is to be issued, and the owner's personal and biometric data are known, a QR dot code can be generated on the basis of the biometric data. This QR dot code can then be stored in the security element by means of an Nd:YAG laser source emitting a 1060 nm laser light beam with 125 W pulses and a 0.2 mm spot diameter, thus sublimating the metallic particles of the security element and thus removing part of the metal layer from the security element 2, thereby leaving a marking 3 in the form of a passport number and said QR dot code within the document substrate 11 of the security document 1, as schematically illustrated in FIG. 4C. Optionally, the QR dot code 3 can be placed in register with symbols 5 printed on the surface of the document support.

In this text, terms generally have the meaning that they commonly have in the art of security documents, and are to be interpreted as they would be interpreted by the person skilled in the art of security documents and security paper. Regarding some of the terms used, a few clarifications are set out below:

"Paper": in this document, the term "paper" preferably refers to a material in sheet form having a basis weight of less than 250 g/m$^2$ and comprising more than 50% by weight of cellulose fibres.

"Security document": The term "security document" refers to a document having particular characteristics which ensure its origin and authenticity. Security documents include documents used by public administrations and public organizations, as well as those used in the private sector, and which contain identification, authentication or anti-forgery means or devices. Security documents include identification documents (such as identification cards, passports, passes and the like) and value documents (such as bills, cheques, stamps, certificates and the like). A security document can be in the form of a security paper, an identification document, a banknote, a cheque, a stamp or a stamp-impressed paper, a label and a ticket. Sometimes, the term "security article" can be used to more generally include not only security documents but also objects that are not "documents" as such but that are provided with security means to guarantee their authenticity. In the present text, the expression "security document" should be understood in a broad sense, that is, not only as a "finished" document held by a final user, but also as encompassing intermediate products, such as blanks from which a final document can be produced, for example, a blank for producing a passport, said blank comprising the document substrate and, within it, the security element.

"Security element": the term "security element" relates to an element which is integrated into or applied to a security document or article for the purpose of authenticating it. The security element can be integrated into the substrate of a document, such as into a paper substrate, such as the paper substrate of a banknote or a paper substrate making up one or more pages of a passport or other identity document; this is frequently the case with security elements in the form of security threads, strips, ribbons, bands, patches, security fibres, watermarks, and elements producing tactile effects. Alternatively, the security element can be applied to the surface of the substrate of the security document; this is often the case with security elements in the form of holograms added to banknotes and credit cards, security inks, plastic sheets or other commonly used elements.

"Substrate of the security element" or "element substrate": Sometimes the material which provides a detectable or measurable security feature, such as an ink, a metal layer, etc., needs a carrier. The expression "substrate of the security element" or "element substrate" relates to said carrier, basically, the base material of which said element is made up. Frequently, the element substrate has a substantially laminar shape, such as the shape of a band or patch, although element substrates can also be fibrillar, in the shape of microparticles or in liquid dispersions such as inks. For example, security threads and holographic strips are usually manufactured using synthetic polymeric substrates, such as polyester or polypropylene substrates. It is also known in the art to use cellulose substrates, in the form of paper substrates (basically obtained by mechanical treatment of the cellulose fibres of natural origin) or cellophane substrates (basically obtained by chemical treatment of said natural cellulose fibres).

"Substrate of a document" or "document substrate": This term typically relates to the support used for the printing or manufacture of the security document, which can contain security features. For example, in the context of banknotes, passports, and other value or identity documents, the document substrate is frequently a paper substrate.

"Thread", "band", "ribbon" and "strip" generally refer to substantially elongate elements, for example, of the type frequently arranged extending throughout the document substrate, from one side or edge to another side or edge, frequently the opposite side or edge. The term "thread" is not intended to imply any limitation in what regards the cross sectional shape of the element, whereas the terms "band", "ribbon" and "strip" are generally intended to imply a substantially flat shape, that is, with a cross section being substantially larger in one direction than in the perpendicular direction.

"Sublimation": This term relates to a physical process in virtue of which a material changes to gas state from solid state without going through liquid state. In the context of this text, it applies to sublimation of material present in and/or on a security element substrate, such as metallic particles present in and/or on a the security element substrate, such as fixed on its surface by means of vacuum printing or metallization techniques.

"Customization": In the present text, "customization" of a security document relates to a certain stage of the manufacturing process of a security document in virtue of which the security document is endowed with a characteristic or feature which makes it original and unique compared to other documents of the same kind. Providing a passport or healthcare card with user identification data, or providing a banknote or cheque with a number, are examples of customization. The customization can involve the addition of a further security feature, for example, when the addition of a customization feature such as the number of a banknote is carried out in a way that involves a technical difficulty, whereby the presence of the customization feature helps to guarantee the authenticity of the document.

"In register": positioning in register implies that one item is positioned in a defined position in relation to another item. For example, a security element or a feature of a security element can be positioned in register with, for example, a feature of a substrate into which the security element is inserted, for example, in relation to an edge of the substrate, or in relation to a mark on or in the substrate, such as a printed mark on the surface of the substrate, or a watermark in the substrate. Since industrial processes always require tolerances, placement of one item in register with another item can render forgery more difficult. Also, the reduction of tolerances also makes it possible to increase the number of security elements that can be included in a security document, thus making it even more difficult to counterfeit the document.

"Marking": A "marking" is understood to include one or more marks, and a detectable marking can serve as a security feature and/or for the customization of a document. For example, a marking can comprise one or more symbols, such as letters, numbers or other symbols, or one or more patterns. Thus, a marking can, for example, include a serial number of a banknote or passport, and/or the name of an owner of an identity document, or an image or coded image of the owner, etc.

In the figures, the dimensions are not intended to be in scale with typical real-life embodiments of the disclosure. Typically, the width/thickness ratio of the security element will be much larger, as the strips are typically very thin, for example, in the order of 50 microns, and rather wide, for example, having a width in the order of 10-35 mm.

In this text, the term "comprises" and its derivations (such as "comprising", etc.) should not be understood in an excluding sense, that is, these terms should not be interpreted as excluding the possibility that what is described and defined may include further elements, steps, etc.

In this present text, whenever intervals or ranges are given, the end points are included, unless the contrary is indicated.

On the other hand, the disclosure is obviously not limited to the specific embodiment(s) described herein, but also encompasses any variations that may be considered by any person skilled in the art (for example, as regards the choice of materials, dimensions, components, configuration, etc.), within the general scope of the disclosure as defined in the claims.

The invention claimed is:

1. Method of providing a security document with a security feature, said security document comprising a document substrate, said document substrate being a paper substrate, said security document further comprising a security element embedded within said document substrate, said security element comprising an element substrate, said security element further comprising a material sensitive to laser light, wherein the method further includes the step of directing laser light onto the document substrate so as to alter said material embedded inside the document substrate, such that laser light is directed onto said document substrate where said security element is embedded so as to provide said security element with a detectable marking; and wherein the step of directing laser light onto the document substrate further includes passing laser light through the document substrate where the document substrate covers the security element such that the detectable marking is disposed where the security element is embedded within the document substrate.

2. Method according to claim 1, wherein the step of directing laser light onto the document substrate is carried out so as to substantially remove at least part of said material, so as to provide said security element with said detectable marking.

3. Method according to claim 2, wherein the step of directing laser light onto the document substrate is carried out so as to substantially sublimate at least part of said material, so as to provide said security element with said detectable marking.

4. Method according to claim 2, wherein said material is a conductive material and/or a metallic material.

5. Method according to claim 4, wherein said material is in the form of metallic particles.

6. Method according to claim 1, wherein said material sensitive to laser light is present as a layer on the security element.

7. Method according to claim 1, further including the step of producing perforations in the material after incorporation of said material onto or into said element substrate but prior to embedding the security element in the document substrate.

8. Method according to claim 7, wherein the step of producing perforations in the material further includes producing perforations in the element substrate.

9. Method according to claim 1, wherein the security element is a strip or a patch.

10. Method according to claim 1, wherein the security element comprises a cellulose substrate.

11. Method according to claim 1, wherein said detectable marking is visible by transmission but not by reflection, and/or wherein said detectable security marking is detectable using magnetic detectors.

12. Method according to claim 1, wherein said detectable marking is made in register with a feature of the document substrate.

13. Method according to claim 12, wherein said detectable marking is made in register with a mark printed on the document substrate or a watermark within the document substrate.

14. Method according to claim 12, wherein said detectable marking is made in register with a mark printed on the document substrate or a watermark within the document substrate, and in register with a side of the document substrate.

15. Method according to claim 12, wherein said detectable marking is made in register with a side of the document substrate.

16. Method according to claim 1, wherein said detectable marking is used to customize the security document.

17. Method according to claim 16, wherein said detectable marking is selected to identify an owner of the security document.

18. Method according to claim 1, wherein the step of directing laser light onto the document substrate so as to alter said material sensitive to laser light so as to provide said security element with a detectable marking, is carried out without substantially affecting the document substrate.

* * * * *